US010460680B2

(12) United States Patent
Zha

(10) Patent No.: US 10,460,680 B2
(45) Date of Patent: Oct. 29, 2019

(54) FLEXIBLE DISPLAY PANEL AND DISPLAY METHOD THEREOF

(71) Applicant: Wuhan China Star Optoelectronics Technology Co., Ltd., Wuhan, Hubei (CN)

(72) Inventor: Guowei Zha, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 249 days.

(21) Appl. No.: 15/545,692

(22) PCT Filed: Jun. 28, 2017

(86) PCT No.: PCT/CN2017/090502

§ 371 (c)(1),
(2) Date: Jul. 22, 2017

(87) PCT Pub. No.: WO2018/205369

PCT Pub. Date: Nov. 15, 2018

(65) Prior Publication Data

US 2019/0213963 A1 Jul. 11, 2019

(30) Foreign Application Priority Data

May 12, 2017 (CN) ..... 2017 1 0335325

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 2320/0209* (2013.01); *G09G 2320/0233* (2013.01); *G09G 2320/0646* (2013.01)

(58) Field of Classification Search
None
See application file for complete search history.

(56) References Cited

U.S. PATENT DOCUMENTS 9,958,712 B2 * 5/2018 Chavez ..... G09G 3/36
2011/0025725 A1 2/2011 Hulze
(Continued)

FOREIGN PATENT DOCUMENTS

CN 102117600 A 7/2011
CN 103295553 A 6/2013
CN 103310765 A 9/2013

*Primary Examiner* — Kenneth B Lee, Jr.
(74) *Attorney, Agent, or Firm* — Andrew C. Cheng

(57) ABSTRACT

The present invention discloses a liquid crystal display panel and a driving method thereof, and a liquid crystal display, which the driving method comprises: normalizing an image to be displayed first, to obtain characteristic data of the input image; extending backlight boundary of each backlight partition according to a default condition, and determining a backlight opening coefficient of each backlight partition by data information after the backlight boundary extension; the backlight opening coefficient of each backlight partition subjected to a fusion process, to obtain a driving current of the liquid crystal display panel; obtaining characteristic data of output image of each backlight partition based on the characteristic data of the input image and the driving current; displaying the output image by the driving current and the characteristic data. It is possible to display high-quality picture information in the case of optical crosstalk existing in the liquid crystal display panel.

18 Claims, 3 Drawing Sheets

(56) References Cited

U.S. PATENT DOCUMENTS

| | | | | |
|---|---|---|---|---|
| 2015/0179111 | A1* | 6/2015 | Chen | G09G 3/3413 345/691 |
| 2017/0061897 | A1 | 3/2017 | Zhang | |
| 2018/0090082 | A1* | 3/2018 | Zhang | G09G 3/3607 |

* cited by examiner

FLEXIBLE DISPLAY PANEL AND DISPLAY METHOD THEREOF

FIELD OF THE INVENTION

The present invention relates to a technology of liquid crystal display, and more particularly, to a liquid crystal display panel, a driving method thereof, and a liquid crystal display.

DESCRIPTION OF PRIOR ART

With the development of liquid crystal display technology, liquid crystal display panel has been involved in all aspects of user life, such as PC, smart phone, and tablet PC.

Because liquid crystal display panel do not have the self-luminous characteristic of organic light-emitting diode, therefore, the liquid crystal display panel needs to use backlight in display. In current, the backlight technology of liquid crystal display mainly includes two incident types of the backlight, straight-incident type and side-incident type. Wherein the straight-incident type backlight module requires the use of light guide plate, and the straight-incident type is mainly achieved by different partitions of the LED to be bright and dark. No matter what incident type is used in the form of dynamic partition to provide backlight.

The existing dynamic partition backlight is mainly based on brightness requirement of different partitions to control a light source individually. However, in the actual display process, due to the light scattering, there are optical crosstalk between adjacent partitions, seriously affecting the quality of the display screen, and affecting the user experience.

SUMMARY OF THE INVENTION

The present invention mainly provides a liquid crystal display pane, a driving method thereof, and a liquid crystal display to the technical problem, it is possible to display high-quality picture information in the case of optical crosstalk existing in the liquid crystal display panel.

In order to solve the above-mentioned technical problem, a technical solution adopted by the present invention is to provide a driving method of a liquid crystal display panel, which comprises the steps of: normalizing an image to be displayed, which the image corresponding to each backlight partition of the liquid crystal display panel, to obtain characteristic data of the input image; extending backlight boundary of each backlight partition according to a default condition, and determining a backlight opening coefficient of each backlight partition by data information after the backlight boundary extension; the backlight opening coefficient of each backlight partition subjected to a fusion process, to obtain a driving current of the liquid crystal display panel; obtaining characteristic data of output image of each backlight partition of the liquid crystal display panel based on the characteristic data of the input image and the driving current; displaying an output image in accordance with the characteristic data of the output image by the driving current to drive the liquid crystal display panel.

In order to solve the above-mentioned technical problem, a second technical solution adopted by the present invention is to provide liquid crystal display panel, which comprises a data input circuit, a data processing circuit, a driving circuit, and a display circuit, and wherein the input circuit, the driving circuit and the display circuit are connected to the data processing circuit respectively and electrically, and the display circuit is further connected to the driving circuit; the data input circuit used for normalizing an image to be displayed, which the image corresponding to each backlight partition of the liquid crystal display panel, to obtain characteristic data of the input image; the data processing circuit used for extending backlight boundary of each backlight partition according to a default condition, and determining a backlight opening coefficient of each backlight partition by data information after the backlight boundary extension; the backlight opening coefficient of each backlight partition subjected to a fusion process, to obtain a driving current of the liquid crystal display panel; obtaining characteristic data of output image of each backlight partition of the liquid crystal display panel based on the characteristic data of the input image and the driving current; the display circuit used for displaying an output image in accordance with the characteristic data of the output image by the driving current to drive the display current.

In order to solve the above-mentioned technical problem, a third technical solution adopted by the present invention is to provide liquid crystal display, which comprises a liquid crystal display panel according to any one of the above-mentioned embodiments.

The present invention can be concluded with the following advantages, the liquid crystal display panel provided by the present invention is different from the prior art that when liquid crystal display panel is drive, normalizing an image to be displayed first, which the image corresponding to each backlight partition of the liquid crystal display panel, to obtain characteristic data of the input image; extending backlight boundary of each backlight partition according to a default condition, and determining a backlight opening coefficient of each backlight partition by data information after the backlight boundary extension; the backlight opening coefficient of each backlight partition subjected to a fusion process, to obtain a driving current of the liquid crystal display panel; obtaining characteristic data of output image of each backlight partition of the liquid crystal display panel based on the characteristic data of the input image and the driving current; finally, displaying an output image in accordance with the characteristic data of the output image by the driving current to drive the liquid crystal display panel. In the present embodiment, obtaining the backlight brightness requirement of backlight of the input image by counting the characteristic data of the current input image, and the optical luminance crosstalk of the adjacent partition of any backlight partitions is added to the backlight calculation of the backlight partition, it is not only to solve the problem that partition brightness controlling is not accurate due to optical crosstalk caused by light diffusion, so that the contrast of display screen is further increased, and the picture quality. Further, the crosstalk light is fully utilized, and the power consumption of the liquid crystal display panel is further saved.

DESCRIPTION OF PREFERRED EMBODIMENT

Figure 1:
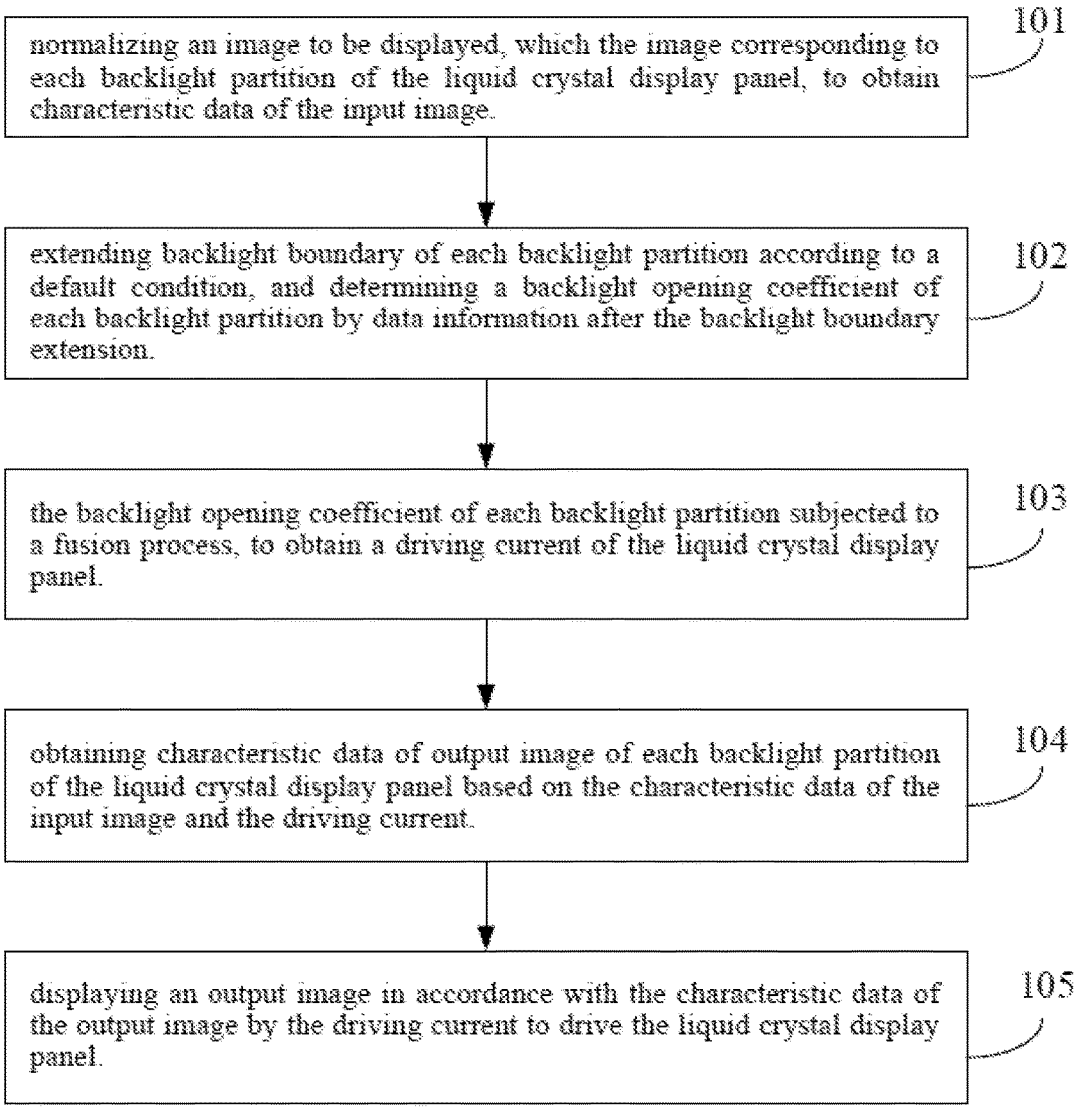
FIG. 1 is a flow chart of method of manufacturing an organic light-emitting diode display panel of an embodiment in the present invention.

Referring to FIG. 1, FIG. 1 is a flow chart of method of manufacturing an organic light-emitting diode display panel of an embodiment in the present invention.

As shown in FIG. 1, the driving method of the present embodiment comprises the following steps:

101: normalizing an image to be displayed, which the image corresponding to each backlight partition of the liquid crystal display panel, to obtain characteristic data of the input image.

The liquid crystal display panel of the present embodiment, in order to realize the maximum degree of uniformity of the display screen and the backlight system, the optical luminance crosstalk caused by the adjacent backlight partition corresponding to each backlight partition of the liquid crystal display pane is counted to the actual controlling information of the backlight partition, to improve the display quality of the liquid crystal display panel.

In the present step, the backlight brightness requirement of image to be displayed is determined by acquiring the input information of the image to be displayed.

Specifically, the liquid crystal display panel first obtain the image to be displayed, and normalizes the image to be displayed for each backlight partition, to obtain the characteristic data indata(height,width,n) of the image to be displayed. In a specific embodiment, the characteristic data is the transmittance of the liquid crystal display panel.

In a specific embodiment, the liquid crystal display panel obtains the characteristic data according to the formula (1).

$$indata(\text{height, width, } n) = \left(\frac{\text{gray(height, width, } n)}{2^{bits}}\right)^{gamma} \quad (1)$$

Wherein, the gray(height,width,n) is a grayscale matrix composed of the input image corresponding to each backlight partition, the height is the resolution of height of the image, the width is the resolution of width of the image, bit is the number of bits of the input image, e.g., the number of bits of the input image is 8 bits, and in other embodiments the bit may be other number, such as 10 bits, it is not limited here, and n is the number of grayscale colors, the number of gray-scale colors may be three colors of R, G, and B, and may be four colors of other color added such as white W or yellow Y, it is not limited here. The gamma is the order of the liquid crystal display panel, i.e., the gamma curve. In the present embodiment, the gamma=2.2, and in other embodiments, the gamma value may be other values such as gamma=2, it is not limited here.

102: extending backlight boundary of each backlight partition according to a default condition, and determining a backlight opening coefficient of each backlight partition by data information after the backlight boundary extension.

Specifically, the liquid crystal display panel first obtains a grayscale matrix formed by maximum grayscale values of image to be displayed, which the image being corresponding to each backlight partition. In a specific embodiment, each grayscale value for each backlight partition is obtained sequentially and counted, obtain each grayscale value corresponding to a number, e.g., there are 5 grayscale values of 200, 3 grayscale values of 178, 7 grayscale values of 255 and so on.

In order to avoid affecting the counting result due to the accidental image noise, to ensure the validity of the maximum grayscale value, and setting a threshold of number for number of the maximum grayscale values. After obtaining the numbers corresponding to each grayscale value, comparing the number corresponding to each grayscale values with a default number threshold, to obtain a grayscale value larger than the number threshold, and the maximum grayscale value is treated as the maximum grayscale value of the backlight partition, and the maximum grayscale value is written into the grayscale matrix.

In another embodiment, because when the gray level value is zero, a light leakage phenomenon may be occurred, so that the brightness of any partition cannot be pure black when the backlight is turned on. Therefore, when the maximum grayscale value of the backlight partition is determined as 0, setting a grayscale value, i.e., when the maximum grayscale value of any partition is detected as 0, it is determined that the default grayscale value is treated as the maximum grayscale value of the partition.

After determining the grayscale matrix formed by maximum grayscale values corresponding to each backlight partition, counting the number of partitions that are adjacent to each backlight partitions and which has optical crosstalk in the backlight partition, determining the number of adjacent partitions with extended backlight boundary. In order to reduce the additional operation due to the error, in the present embodiment, a threshold value is set for the degree of optical crosstalk, when the degree of optical crosstalk in the adjacent partition exceeds the threshold the adjacent partition is determined as an adjacent partition of the backlight partition for boundary extension.

After determining the number of adjacent partitions with extended backlight boundary, which the adjacent partition being in each backlight partition, then extending backlight boundary of each backlight partition by using the number. For example, setting the matrix of backlight opening coefficient for each partition as Blu(block_num_x, block_num_y), wherein x and y are the coordinates of the corresponding backlight partition, the matrix of backlight opening coefficient of backlight partitions in which after the boundary is extended is Blu_new(block_num_x+2m, block_num_y+2n), wherein m is the number of adjacent partitions in which the boundary is extended horizontally, and n is the number of adjacent partitions in which the boundary is extended in the longitudinal direction.

Figure 2:
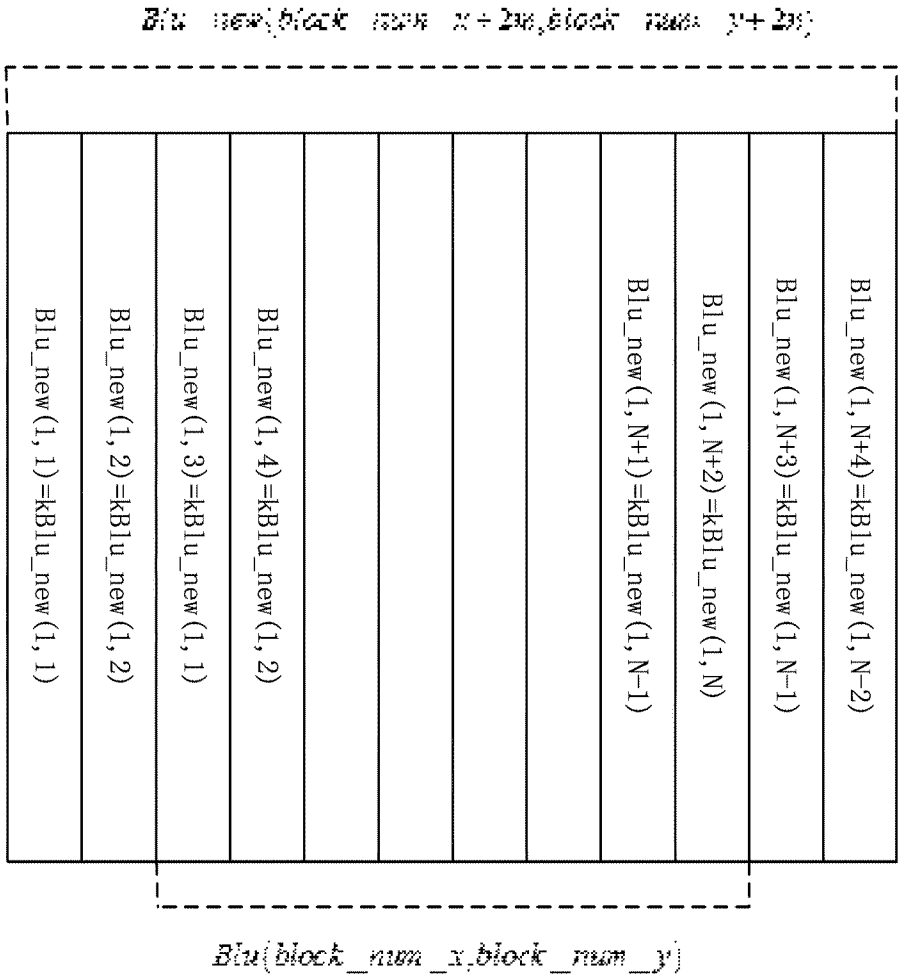
FIG. 2 is a diagram of extending the backlight opening coefficient in accordance with a driving method of the liquid crystal display panel of a specific embodiment of the present invention.

Because light is reflected in the transmission process, there may be a mirror response between adjacent partitions, therefore, in the boundary extension, the mirror response caused by optical brightness crosstalk is also taken into consider, i.e., there are coefficients of 2 in front of m and n in the function, to increase the accuracy of the backlight opening coefficient while solving. To simplify the calculation, for m=0, n=2 as an example, referring to FIG. 2, substituting values into the matrix of backlight opening coefficient of backlight partitionBlu(block_num_x, block_num_y) by the symmetry form, and the others are substituted 0.

For example:

$$\text{Blu_new}(1,1)=k\text{Blu}(1,3),\text{Blu_new}(1,2)=k\text{Blu}(1,2),$$

$$\text{Blu_new}(1,3)=k\text{Blu}(1,1),\text{Blu_new}(1,4)=k\text{Blu}(1,2),$$

Finally, determining a backlight opening coefficient of each backlight partitions in which after the boundary is extended by the grayscale matrix formed by maximum grayscale values and the minimum extension coefficient of each backlight partitions of the liquid display panel, the minimum extension coefficient is determined by pixel partitions corresponding to the partition, when the pixel distribution is determined, the minimum extension coefficient is also determined. Wherein the minimum extension coefficient represents the degree of optical luminance crosstalk of the backlight partition.

In an alternative embodiment, the minimum extension coefficient of the adjacent symmetric partitions corresponding to each backlight partitions are the same. For example, in the present embodiment, diff1=diff5=0.2, diff2=diff4=0.7, diff3=1.

Figure 3:
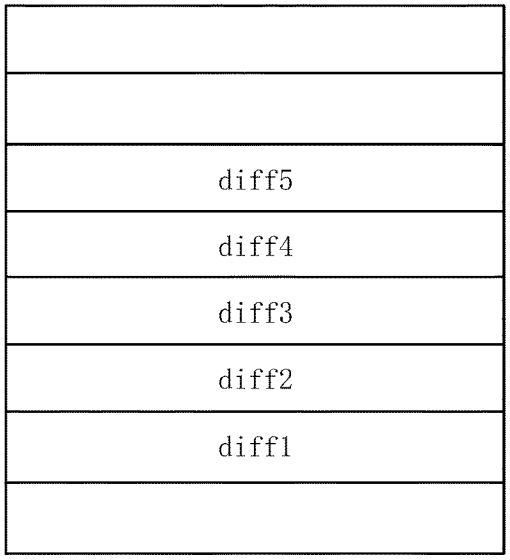
FIG. 3 is a distribution diagram of the minimum extension coefficient in accordance with a driving method of the liquid crystal display panel of a specific embodiment of the present invention.

Specifically, in order to simplify the calculation, for m=0, n=2 as an example, referring to FIG. 3, i.e., the brightness of any backlight partition is mainly contributed by superimposing the brightness of two adjacent partitions which is the current partition and a partition in the horizontal direction. Considering the mirror response, i.e., there are five backlight partitions extended boundary, setting five minimum extension coefficients as diff1, diff2, diff3, diff4, and diff5, respectively. For any backlight partition (1, N), the following multiple linear equation can be described.

$$\max(1, N) = \text{diff1} \times \text{Blu_nem}(1, N-2) + \text{diff2} \times \text{Blu_nem}(1, N-1) + \text{diff3} \times \text{Blu_nem}(1, N) + \text{diff4} \times \text{Blu_nem}(1, N+1) + \text{diff5} \times \text{Blu_nem}(1, N+5)$$

By solving the multiple linear equation, the backlight opening coefficient Blu_nem(block_num_x,block_num_y) in which after the boundary is extended is obtained, then according to the inverse calculation of the boundary extension, the backlight opening coefficient of each backlight partitions Blu(block_num_x,block_num_y) can be obtained.

In order to ensure the validity of the backlight opening coefficient, setting ratio threshold. When the backlight opening coefficient is less than the ratio threshold, the backlight opening coefficient is set as 0. For example, in general, the number of bits of the backlight opening coefficient can take the ratio threshold as 1/2^bit_2.

103: the backlight opening coefficient of each backlight partition subjected to a fusion process, to obtain a driving current of the liquid crystal display panel.

Specifically, calculating the luminance distribution of the entire liquid crystal display panel based on the backlight opening coefficient Blu_nem(block_num_x,block_num_y) after the boundary extension, to obtain brightness distribution, i.e., the driving current Lum(blu_height,blu_width) of the liquid crystal display panel, wherein the blu_height and blu_width are the dimension of the brightness processing matrix.

In other embodiments, in order to further improve the accuracy of the calculation, the dimension of the luminance processing matrix describing the backlight accuracy is extended to image grayscale, i.e., the brightness distributionLum(blu_height,blu_width) is extended to full image resolutionLum_new(height,width).

In other embodiments, it is also possible to determine the driving voltage of the liquid crystal display panel, it is not limited here.

104: obtaining characteristic data of output image of each backlight partition of the liquid crystal display panel based on the characteristic data of the input image and the driving current.

Specifically, in the present embodiment, an output image-outdata(height,width,n) of each backlight partition is obtained by formula (2).

$$\text{outdata}(\text{height},\text{width},n) = \min(1, \text{Lum_new}(\text{height},\text{width})) \times \text{indata}(\text{height},\text{width},n) \quad (2)$$

Wherein the Lum_new(height,width) is the image resolution corresponding to the drive current, the height is the resolution of height of the image, the width is the resolution of width of the image, n is the number of grayscale colors.

In the present embodiment, the characteristic data of output image is an image transmittance, in order to ensure the validity of the image transmittance, after the characteristic data is calculated, further comparing with the image transmittance and 1, when the characteristic data exceeds the image transmittance with maximum value 1, determining the characteristic data of the output image as 1.

105: displaying an output image in accordance with the characteristic data of the output image by the driving current to drive the liquid crystal display panel.

Specifically, transferring the characteristic data of the output image to an image driving unit, and supplying the driving current to a backlight brightness controller. Specifically, because the input image is converted by the gamma function when the original calculation is performed. Therefore, when the output image corresponding to the input image is displayed, the output image is subjected to inverse gamma function processing first, then output to the image driving unit for displaying, i.e., the inverse gamma function calculation is performed by the following formula.

$$\text{gray_new}(\text{height},\text{width},n) = 2^{bit} \times \text{outdata}(\text{height},\text{width},n)^{1/gamma}$$

The present invention can be concluded with the following advantages, the liquid crystal display panel provided by the present invention is different from the prior art that when liquid crystal display panel is drive, normalizing an image to be displayed first, which the image corresponding to each backlight partition of the liquid crystal display panel, to obtain characteristic data of the input image; extending backlight boundary of each backlight partition according to a default condition, and determining a backlight opening coefficient of each backlight partition by data information after the backlight boundary extension; the backlight opening coefficient of each backlight partition subjected to a fusion process, to obtain a driving current of the liquid crystal display panel; obtaining characteristic data of output image of each backlight partition of the liquid crystal display panel based on the characteristic data of the input image and the driving current; finally, displaying an output image in accordance with the characteristic data of the output image by the driving current to drive the liquid crystal display panel. In the present embodiment, obtaining the backlight brightness requirement of backlight of the input image by counting the characteristic data of the current input image, and the optical luminance crosstalk of the adjacent partition of any backlight partitions is added to the backlight calculation of the backlight partition, it is not only to solve the problem that partition brightness controlling is not accurate due to optical crosstalk caused by light diffusion, so that the contrast of display screen is further increased, and the picture quality. Further, the crosstalk light is fully utilized, and the power consumption of the liquid crystal display panel is further saved.

Figure 4:
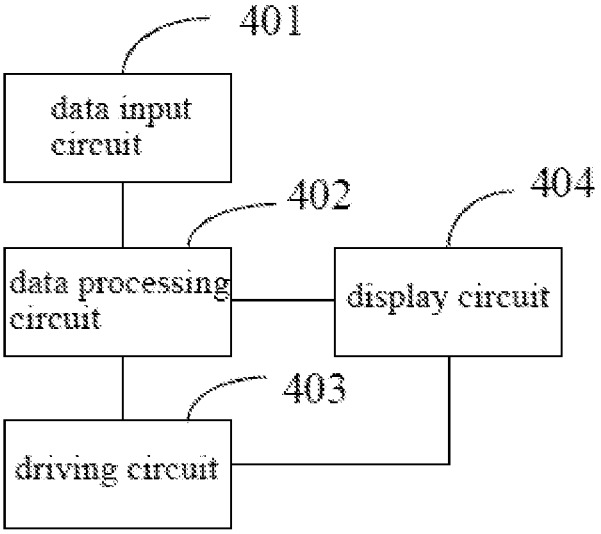
FIG. 4 is a structural illustration of the ISIM-based intelligent terminal in accordance with another specific embodiment of the present invention.

Referring to FIG. 4, FIG. 4 is a structural illustration in accordance with an embodiment of the present invention. The liquid crystal display panel of the present embodiment can implement the driving method according to any one of the above-mentioned embodiments.

As shown in FIG. 4, the liquid crystal display panel of the present embodiment comprises a data input circuit 401, a data processing circuit 402, a driving circuit 403, and a display circuit 404, and wherein the input circuit 401, the driving circuit 403 and the display circuit 404 are connected to the data processing circuit 402 respectively and electrically, and the display circuit 404 is further connected to the driving circuit 403.

The data input circuit 401 is used for normalizing an image to be displayed, which the image is corresponding to each backlight partition of the liquid crystal display panel, to obtain characteristic data of the input image.

The liquid crystal display panel of the present embodiment, in order to realize the maximum degree of uniformity of the display screen and the backlight system, the optical luminance crosstalk caused by the adjacent backlight partition corresponding to each backlight partition of the liquid crystal display pane is counted to the actual controlling information of the backlight partition, to improve the display quality of the liquid crystal display panel.

The data input circuit 401 determines the backlight brightness requirement of image to be displayed by acquiring the input information of the image to be displayed.

Specifically, the data input circuit 401 first obtain the image to be displayed, and normalizes the image to be displayed for each backlight partition, to obtain the characteristic data indata(height,width,n) of the image to be displayed. In a specific embodiment, the characteristic data is the transmittance of the liquid crystal display panel.

In a specific embodiment, the data input circuit 401 obtains the characteristic data according to the formula (1).

$$indata(\text{height, width}, n) = \left(\frac{\text{gray(height, width}, n)}{2^{bits}}\right)^{gamma} \quad (1)$$

Wherein, the gray(height,width,n) is a grayscale matrix composed of the input image corresponding to each backlight partition, the height is the resolution of height of the image, the width is the resolution of width of the image, bit is the number of bits of the input image, e.g., the number of bits of the input image is 8 bits, and in other embodiments the bit may be other number, such as 10 bits, it is not limited here, and n is the number of grayscale colors, the number of gray-scale colors may be three colors of R, G, and B, and may be four colors of other color added such as white W or yellow Y, it is not limited here. The gamma is the order of the liquid crystal display panel, i.e., the gamma curve. In the present embodiment, the gamma=2.2, and in other embodiments, the gamma value may be other values such as gamma=2, it is not limited here.

The data processing circuit 402 is used for extending backlight boundary of each backlight partition according to a default condition, and determining a backlight opening coefficient of each backlight partition by data information after the backlight boundary extension. The backlight opening coefficient of each backlight partition is subjected to a fusion process, to obtain a driving current of the liquid crystal display panel. Obtaining characteristic data of output image of each backlight partition of the liquid crystal display panel based on the characteristic data of the input image and the driving current.

Specifically, the data processing circuit 402 first obtains a grayscale matrix formed by maximum grayscale values of image to be displayed, which the image being corresponding to each backlight partition. In a specific embodiment, each grayscale value for each backlight partition is obtained sequentially and counted, obtain each grayscale value corresponding to a number, e.g., there are 5 grayscale values of 200, 3 grayscale values of 178, 7 grayscale values of 255 and so on.

In order to avoid affecting the counting result due to the accidental image noise, to ensure the validity of the maximum grayscale value, and setting a threshold of number for number of the maximum grayscale values. After the data processing circuit 402 obtains the numbers corresponding to each grayscale value, comparing the number corresponding to each grayscale values with a default number threshold, to obtain a grayscale value larger than the number threshold, and the maximum grayscale value is treated as the maximum grayscale value of the backlight partition, and the maximum grayscale value is written into the grayscale matrix.

In another embodiment, because when the gray level value is zero, a light leakage phenomenon may be occurred, so that the brightness of any partition cannot be pure black when the backlight is turned on. Therefore, when the maximum grayscale value of the backlight partition is determined as 0, setting a grayscale value, when the data processing circuit 402 detects the maximum grayscale value of any partition as 0, it is determined that the default grayscale value is treated as the maximum grayscale value of the partition.

After the data processing circuit 402 determines the grayscale matrix formed by maximum grayscale values corresponding to each backlight partition, counting the number of partitions that are adjacent to each backlight partitions and which has optical crosstalk in the backlight partition, determining the number of adjacent partitions with extended backlight boundary. In order to reduce the additional operation due to the error, in the present embodiment, a threshold value is set for the degree of optical crosstalk, when the degree of optical crosstalk in the adjacent partition exceeds the threshold the adjacent partition is determined as an adjacent partition of the backlight partition for boundary extension.

After the data processing circuit 402 determines the number of adjacent partitions with extended backlight boundary, which the adjacent partition being in each backlight partition, then extending backlight boundary of each backlight partition by using the number. For example, setting the matrix of backlight opening coefficient for each partition as Blu(block_num_x,block_num_y), wherein x and y are the coordinates of the corresponding backlight partition, the matrix of backlight opening coefficient of backlight partitions in which after the boundary is extended is Blu_new(block_num_x+2m,block_num_+2n), wherein m is the number of adjacent partitions in which the boundary is extended horizontally, and n is the number of adjacent partitions in which the boundary is extended in the longitudinal direction.

Because light is reflected in the transmission process, there may be a mirror response between adjacent partitions, therefore, in the boundary extension, the mirror response caused by optical brightness crosstalk is also taken into consider, i.e., there are coefficients of 2 in front of m and n in the function, to increase the accuracy of the backlight opening coefficient while solving. To simplify the calculation, for m=0, n=2 as an example, referring to FIG. 2, substituting values into the matrix of backlight opening coefficient of backlight partition Blu(block_num_x, block_num_y) by the symmetry form, and the others are substituted 0.

For example:

$$Blu_new(1,1)=kBlu(1,3),Blu_new(1,2)=kBlu(1,2),$$

$$Blu_new(1,3)=kBlu(1,1),Blu_new(1,4)=kBlu(1,2),$$

Finally, determining a backlight opening coefficient of each backlight partitions in which after the boundary is extended by the grayscale matrix formed by maximum grayscale values and the minimum extension coefficient of each backlight partitions of the liquid display panel, the minimum extension coefficient is determined by pixel partitions corresponding to the partition, when the pixel distribution is determined, the minimum extension coefficient is also determined. Wherein the minimum extension coefficient represents the degree of optical luminance crosstalk of the backlight partition.

In an alternative embodiment, the minimum extension coefficient of the adjacent symmetric partitions corresponding to each backlight partitions are the same. For example, in the present embodiment, diff1=diff5=0.2, diff2=diff4=0.7, diff3=1.

Specifically, in order to simplify the calculation, for m=0, n=2 as an example, the brightness of any backlight partition is mainly contributed by superimposing the brightness of two adjacent partitions which is the current partition and a partition in the horizontal direction. Considering the mirror response, i.e., there are five backlight partitions extended boundary, setting five minimum extension coefficients as diff1, diff2, diff3, diff4, and diff5, respectively. For any backlight partition (1, N), the following multiple linear equation can be described.

$$\begin{aligned}\max(1,N) = {} & \mathrm{diff1}\times Blu_nem(1,N-2)+\\ & \mathrm{diff2}\times Blu_nem(1,N-1)+\mathrm{diff3}\times Blu_nem(1,N)+\\ & \mathrm{diff4}\times Blu_nem(1,N+1)+\mathrm{diff5}\times Blu_nem(1,N+5)\end{aligned}$$

By solving the multiple linear equation, the backlight opening coefficient Blu_nem(block_num_,block_num_y) in which after the boundary is extended is obtained, then according to the inverse calculation of the boundary extension, the backlight opening coefficient of each backlight partitions Blu(block_num_x,block_num_y) can be obtained.

In order to ensure the validity of the backlight opening coefficient, setting a ratio threshold. When the backlight opening coefficient is less than the ratio threshold, the backlight opening coefficient is set as 0. For example, in general, the number of bits of the backlight opening coefficient can take the ratio threshold as 1/2^bit_2.

The data processing circuit 402 subjects further the backlight opening coefficient of each backlight partition to a fusion process, to obtain a driving current of the liquid crystal display panel.

Specifically, the data processing circuit 402 calculates the luminance distribution of the entire liquid crystal display panel based on the backlight opening coefficient Blu_nem (block_num_x,block_num_y) after the boundary extension, to obtain brightness distribution, i.e., the driving current Lum(blu_height,blu_width) of the liquid crystal display panel, wherein the blu_height and blu_width are the dimension of the brightness processing matrix.

In other embodiments, in order to further improve the accuracy of the calculation, the dimension of the luminance processing matrix describing the backlight accuracy is extended to image grayscale, i.e., the brightness distribution Lum(blu_height,blu_width) is extended to full image resolution Lum_new(height,width).

In other embodiments, it is also possible to determine the driving voltage of the liquid crystal display panel by the data processing circuit 402, it is not limited here.

The data processing circuit 402 obtains characteristic data of output image of each backlight partition of the liquid crystal display panel based on the characteristic data of the input image and the driving current.

Specifically, in the present embodiment, an output image outdata(height,width,n) of each backlight partition is obtained by formula (2).

$$outdata(height,width,n)=\min(1,Lum_new(height,width))\times indata(height,width,n) \quad (2)$$

Wherein the Lum_new(height,width) is the image resolution corresponding to the drive current, the height is the resolution of height of the image, the width is the resolution of width of the image, n is the number of grayscale colors.

In the present embodiment, the characteristic data of output image is an image transmittance, in order to ensure the validity of the image transmittance, after the characteristic data is calculated, further comparing with the image transmittance and 1, when the characteristic data exceeds the image transmittance with maximum value 1, determining the characteristic data of the output image as 1.

The driving circuit 403 is used for displaying an output image in accordance with the characteristic data of the output image by the driving current to drive the liquid crystal display panel.

Specifically, the driving circuit 403 transfers the characteristic data of the output image to an image driving unit, and supplying the driving current to a backlight brightness controller. Specifically, because the input image is converted by the gamma function when the original calculation is performed. Therefore, when the output image corresponding to the input image is displayed, the output image is subjected to inverse gamma function processing first, then output to the image driving unit for displaying, i.e., the inverse gamma function calculation is performed by the following formula.

$$gray_new(height,width,n)=2^{bit}\times outdata(height,width,n)^{1/gamma}$$

The liquid crystal display panel provided by the present invention is different from the prior art that obtaining the backlight brightness requirement of backlight of the input image by counting the characteristic data of the current input image, and the optical luminance crosstalk of the adjacent partition of any backlight partitions is added to the backlight calculation of the backlight partition, it is not only to solve the problem that partition brightness controlling is not accurate due to optical crosstalk caused by light diffusion, so that the contrast of display screen is further increased, and the picture quality. Further, the crosstalk light is fully utilized, and the power consumption of the liquid crystal display panel is further saved.

In addition, the present invention also provides a liquid crystal display, which comprises a liquid crystal display panel according to any one of the above-mentioned embodiments. Obtaining the backlight brightness requirement of backlight of the input image by counting the characteristic data of the current input image, and the optical luminance crosstalk of the adjacent partition of any backlight partitions is added to the backlight calculation of the backlight partition, it is not only to solve the problem that partition brightness controlling is not accurate due to optical crosstalk caused by light diffusion, so that the contrast of display screen is further increased, and the picture quality. Further, the crosstalk light is fully utilized, and the power consumption of the liquid crystal display panel is further saved.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A driving method of a liquid crystal display panel, wherein the driving method comprises the steps of:

normalizing an image to be displayed, which the image corresponding to each backlight partition of the liquid crystal display panel, to obtain characteristic data of the input image;

extending backlight boundary of each backlight partition according to a default condition, and determining a backlight opening coefficient of each backlight partition by data information after the backlight boundary extension;

the backlight opening coefficient of each backlight partition subjected to a fusion process, to obtain a driving current of the liquid crystal display panel;

obtaining characteristic data of output image of each backlight partition of the liquid crystal display panel based on the characteristic data of the input image and the driving current;

displaying an output image in accordance with the characteristic data of the output image by the driving current to drive the liquid crystal display panel.

2. The driving method as recited in claim 1, wherein the normalizing an image to be displayed which the image corresponding to each backlight partition of the liquid crystal display panel to obtain characteristic data of the input image comprises:

according to formula (1), normalizing an image to be displayed, which the image corresponding to each backlight partition of the liquid crystal display panel, to obtain the characteristic data indata(height, width, n);

$$indata(\text{height, width}, n) = \left(\frac{\text{gray(height, width}, n)}{2^{bits}}\right)^{gamma} \quad (1)$$

wherein, the gray(height, width, n) is a grayscale matrix composed of the input image corresponding to each backlight partition, the height is the resolution of height of the image, the width is the resolution of width of the image, n is the number of grayscale colors, bit is the number of bits of the input image.

3. The driving method as recited in claim 2, wherein the number of the grayscale colors is one of three or four.

4. The driving method as recited in claim 1, wherein the extending backlight boundary of each backlight partition according to a default condition and determining a backlight opening coefficient of each backlight partition by data information after the backlight boundary extension comprises:

obtaining a grayscale matrix formed by maximum grayscale values of image to be displayed, which the image being corresponding to each backlight partition of the liquid crystal display panel;

determining the number of adjacent partitions with extended backlight boundary, which the adjacent partition being in each backlight partition, then extending backlight boundary of each backlight partition by using the number;

determining a backlight opening coefficient after the boundary expansion of each backlight partition by the grayscale matrix and the minimum extension coefficient of each backlight partition of the liquid crystal display panel; wherein the minimum extension coefficient is determined by a pixel partition corresponding to the partition.

5. The method as recited in claim 4, wherein the obtaining a grayscale matrix formed by maximum grayscale value of image to be displayed which the image being corresponding to each backlight partition of the liquid crystal display panel comprises:

obtaining sequentially the grayscale values of the image to be displayed of each backlight partition, to obtain a number corresponding to each grayscale values of backlight partition;

comparing the number corresponding to each grayscale values with a default number threshold, to obtain a grayscale value larger than the number threshold, and determining the maximum grayscale value that the number larger than the number threshold, which treated as the maximum grayscale value corresponding to backlight partition.

6. The method as recited in claim 4, wherein when the maximum grayscale value in any partition is detected as 0, determining the default grayscale value as the maximum grayscale value of the partition.

7. The method as recited in claim 4, wherein the minimum extension coefficients of the adjacent symmetric partitions corresponding to each backlight partition are the same.

8. The method as recited in claim 5, wherein when the maximum grayscale value in any partition is detected as 0, determining the default grayscale value as the maximum grayscale value of the partition.

9. The method as recited in claim 1, wherein the obtaining characteristic data of output image of each backlight partition of the liquid crystal display panel based on the characteristic data of the input image and the driving current comprises:

obtaining an output image outdata (height, width, n) of each backlight partition by formula (2);

$$\text{outdata(height,width,}n\text{)=min(1,Lum_new(height, width))}\times\text{indata(height,width,}n\text{)} \quad (2)$$

wherein the Lum_new(height, width)is the image resolution corresponding to the drive current, the height is the resolution of height of the image, the width is the resolution of width of the image, n is the number of grayscale colors.

10. A liquid crystal display panel, wherein the liquid crystal display panel comprises a data input circuit, a data processing circuit, a driving circuit, and a display circuit, and wherein the input circuit, the driving circuit and the display circuit are connected to the data processing circuit respectively and electrically, and the display circuit is further connected to the driving circuit;

the data input circuit used for normalizing an image to be displayed, which the image corresponding to each backlight partition of the liquid crystal display panel, to obtain characteristic data of the input image;

the data processing circuit used for extending backlight boundary of each backlight partition according to a default condition, and determining a backlight opening coefficient of each backlight partition by data information after the backlight boundary extension; the backlight opening coefficient of each backlight partition subjected to a fusion process, to obtain a driving current of the liquid crystal display panel; obtaining characteristic data of output image of each backlight partition of the liquid crystal display panel based on the characteristic data of the input image and the driving current;

the display circuit used for displaying an output image in accordance with the characteristic data of the output image by the driving current to drive the display current.

11. The liquid crystal display panel as recited in claim 10, wherein the data processing circuit specifically normalizes an image to be displayed, which the image corresponding to each backlight partition of the liquid crystal display panel according to formula (1), to obtain the characteristic data indata(height, width, n);

$$indata(\text{height, width}, n) = \left(\frac{\text{gray(height, width}, n)}{2^{bits}}\right)^{gamma} \quad (1)$$

wherein, the gray(height, width, n) is a grayscale matrix composed of the input image corresponding to each backlight partition, the height is the resolution of height of the image, the width is the resolution of width of the image, n is the number of grayscale colors, bit is the number of bits of the input image.

12. The liquid crystal display panel as recited in claim 11, wherein the number of the grayscale colors is one of three or four.

13. The liquid crystal display panel as recited in claim 10, wherein when the data processing circuit process to extending backlight boundary of each backlight partition according to a default condition and determining a backlight opening coefficient of each backlight partition by data information after the backlight boundary extension, the data processing circuit is specifically used for obtaining a grayscale matrix formed by maximum grayscale values of image to be displayed, which the image being corresponding to each backlight partition of the liquid crystal display panel;

determining the number of adjacent partitions with extended backlight boundary, which the adjacent partition being in each backlight partition, then extending backlight boundary of each backlight partition by using the number;

determining a backlight opening coefficient after the boundary expansion of each backlight partition by the grayscale matrix and the minimum extension coefficient of each backlight partition of the liquid crystal display panel; wherein the minimum extension coefficient is determined by a pixel partition corresponding to the partition.

14. The liquid crystal display panel as recited in claim 13, wherein when the data processing circuit obtains a grayscale matrix formed by maximum grayscale values of image to be displayed which the image of each backlight partition of the liquid crystal display panel, the data processing circuit is specifically used for:

obtaining sequentially the grayscale values of the image to be displayed of each backlight partition, to obtain a number corresponding to each grayscale values of backlight partition;

comparing the number corresponding to each grayscale values with a default number threshold, to obtain a grayscale value larger than the number threshold, and determining the maximum grayscale value that the number larger than the number threshold, which treated as the maximum grayscale value corresponding to backlight partition.

15. The liquid crystal display panel as recited in claim 13, when the data processing circuit detects the maximum grayscale value in any partition as 0, determining the default grayscale value as the maximum grayscale value of the partition.

16. The liquid crystal display panel as recited in claim 13, wherein the minimum extension coefficients of the adjacent symmetric partitions corresponding to each backlight partition are the same.

17. The liquid crystal display panel as recited in claim 11, wherein when the liquid crystal display panel obtains characteristic data of output image of each backlight partition of the liquid crystal display panel based on the characteristic data of the input image and the driving current, the liquid crystal display panel is specifically used for:

obtaining an output image outdata(height, width, n) of each backlight partition by formula (2);

$$\text{outdata(height,width,}n\text{)=min(1,Lum_new(height, width))}\times\text{indata(height,width,}n\text{)} \quad (2)$$

wherein the Lum_new(height, width) is the image resolution corresponding to the drive current, the height is the resolution of height of the image, the width is the resolution of width of the image, n is the number of grayscale colors.

18. A liquid crystal display, wherein the liquid crystal display comprises a liquid crystal display panel, and the liquid crystal display panel comprises a data input circuit, a data processing circuit, a driving circuit, and a display circuit, and wherein the input circuit, the driving circuit and the display circuit are connected to the data processing circuit respectively and electrically, and the display circuit is further connected to the driving circuit;

the data input circuit used for normalizing an image to be displayed, which the image corresponding to each backlight partition of the liquid crystal display panel, to obtain characteristic data of the input image;

the data processing circuit used for extending backlight boundary of each backlight partition according to a default condition, and determining a backlight opening coefficient of each backlight partition by data information after the backlight boundary extension; the backlight opening coefficient of each backlight partition subjected to a fusion process, to obtain a driving current of the liquid crystal display panel; obtaining characteristic data of output image of each backlight partition of the liquid crystal display panel based on the characteristic data of the input image and the driving current;

the display circuit used for displaying an output image in accordance with the characteristic data of the output image by the driving current to drive the display current.

* * * * *